US011168551B2

(12) United States Patent
Watson et al.

(10) Patent No.: US 11,168,551 B2
(45) Date of Patent: Nov. 9, 2021

(54) GAS PURGING FOR ELECTRIC SUBMERSIBLE PUMPING SYSTEM

(71) Applicant: SCHLUMBERGER TECHNOLOGY CORPORATION, Sugar Land, TX (US)

(72) Inventors: Arthur I. Watson, Sugar Land, TX (US); Grant T. Harris, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 151 days.

(21) Appl. No.: 16/344,290

(22) PCT Filed: Oct. 23, 2017

(86) PCT No.: PCT/US2017/057777

§ 371 (c)(1),
(2) Date: Apr. 23, 2019

(87) PCT Pub. No.: WO2018/076000

PCT Pub. Date: Apr. 26, 2018

(65) Prior Publication Data

US 2019/0271324 A1 Sep. 5, 2019

Related U.S. Application Data

(60) Provisional application No. 62/411,647, filed on Oct. 23, 2016.

(51) Int. Cl.
*E21B 43/12* (2006.01)
*E21B 43/38* (2006.01)
(Continued)

(52) U.S. Cl.
CPC ..... *E21B 43/128* (2013.01); *E21B 43/38* (2013.01); *F04D 9/003* (2013.01); *F04D 13/10* (2013.01);
(Continued)

(58) Field of Classification Search
CPC ..... E21B 43/128; E21B 43/13; E21B 43/38
See application file for complete search history.

(56) References Cited

U.S. PATENT DOCUMENTS 2,363,420 A 11/1944 Howard
3,384,769 A * 5/1968 Schaefer ..... H02K 5/1285 310/87

(Continued)

FOREIGN PATENT DOCUMENTS

KR 100364407 B1 12/2002
WO 2015178887 A1 11/2015
WO 2016053588 A1 4/2016

OTHER PUBLICATIONS

Office action issued in the U.S. Appl. No. 15/767,152, dated Nov. 5, 2020 (27 pages).

(Continued)

*Primary Examiner* — Cathleen R Hutchins

(57) ABSTRACT

A technique facilitates removal of gas from a gas-sensitive region in an electric submersible pumping system. A gas purging system is integrated into the electric submersible pumping system. During operation of the electric submersible pumping system, the gas purging system also is operated to move gas away from the gas-sensitive region, e.g. a thrust bearing region, and to a collection region or other suitable region. In some embodiments, the gas which accumulates in a collection region may be discharged to a region external of the electric submersible pumping system.

18 Claims, 6 Drawing Sheets

(51) Int. Cl.

| | |
|---|---|
| ***F04D 13/10*** | (2006.01) |
| ***F04D 29/041*** | (2006.01) |
| ***F04D 29/06*** | (2006.01) |
| ***F04D 9/00*** | (2006.01) |

(52) U.S. Cl.
CPC ..... *F04D 29/0413* (2013.01); *F04D 29/061* (2013.01)

(56) References Cited

U.S. PATENT DOCUMENTS

| | | | |
|---|---|---|---|
| 3,404,924 | A | 10/1968 | Choate |
| 3,718,379 | A | 2/1973 | Williams et al. |
| 3,867,056 | A | 2/1975 | Carle et al. |
| 4,362,020 | A | 12/1982 | Meacher et al. |
| 4,477,235 | A | 10/1984 | Gilmer et al. |
| 4,792,296 | A | 12/1988 | Kobayashi et al. |
| 4,798,476 | A | 1/1989 | Sakatani et al. |
| 4,805,972 | A | 2/1989 | Tanaka et al. |
| 5,160,240 | A | 11/1992 | Wilson |
| 5,207,810 | A | 5/1993 | Sheth |
| 6,246,136 | B1 | 6/2001 | Ichiyama |
| 6,345,968 | B1 | 2/2002 | Shupe |
| 6,361,214 | B1 | 3/2002 | Ichiyama |
| 6,524,006 | B1 | 2/2003 | Lee |
| 6,929,064 | B1 | 8/2005 | Susman |
| 7,819,644 | B2 | 10/2010 | Eber et al. |
| 8,016,571 | B2 | 9/2011 | Speer et al. |
| 8,684,679 | B2 | 4/2014 | Tetzlaff et al. |
| 8,807,966 | B2 | 8/2014 | Du et al. |
| 8,932,034 | B2 | 1/2015 | McKinney et al. |
| 2001/0001269 | A1 | 5/2001 | Asai |
| 2005/0087343 | A1 | 4/2005 | Du |
| 2005/0109515 | A1 | 5/2005 | Watson et al. |
| 2006/0204359 | A1 | 9/2006 | Semple et al. |
| 2009/0010773 | A1 | 1/2009 | Parmeter et al. |
| 2010/0258306 | A1* | 10/2010 | Camilleri ..... E21B 43/38 166/265 |
| 2010/0321823 | A1 | 12/2010 | Oe et al. |
| 2012/0257998 | A1 | 10/2012 | Parmeter et al. |
| 2012/0263610 | A1* | 10/2012 | Tetzlaff ..... F04D 29/0413 417/410.1 |
| 2014/0219825 | A1* | 8/2014 | Santos ..... E21B 43/121 417/53 |
| 2014/0307989 | A1 | 10/2014 | Leuthold |
| 2015/0023815 | A1 | 1/2015 | Tetzlaff et al. |
| 2015/0184671 | A1 | 7/2015 | Parmeter et al. |
| 2015/0188384 | A1 | 7/2015 | Rumbaugh et al. |
| 2015/0211527 | A1 | 7/2015 | St. John et al. |
| 2016/0133431 | A1 | 5/2016 | Hunt et al. |
| 2017/0037861 | A1 | 2/2017 | Rutter et al. |
| 2017/0130730 | A1 | 5/2017 | Torkildsen |
| 2017/0167498 | A1 | 6/2017 | Chang et al. |
| 2017/0260990 | A1* | 9/2017 | Pyron ..... F04D 29/061 |
| 2018/0298910 | A1 | 10/2018 | Watson |
| 2019/0271324 | A1 | 9/2019 | Watson et al. |

OTHER PUBLICATIONS

International Search Report and Written Opinion issued in the PCT Application PCT/US2016/055242, dated Dec. 14, 2016 (15 pages).
International Preliminary Report on Patentability issued in the PCT Application PCT/US2016/055242, dated Apr. 17, 2018 (11 pages).
International Search Report and Written Opinion issued in the PCT Application PCT/US2017/057777, dated Feb. 7, 2018 (18 pages).
International Preliminary Report on Patentability issued in the PCT Application PCT/US2017/057777, dated Apr. 23, 2019 (14 pages).

* cited by examiner

GAS PURGING FOR ELECTRIC SUBMERSIBLE PUMPING SYSTEM

CROSS-REFERENCE TO RELATED APPLICATION

The present document is based on and claims priority to U.S. Provisional Application Ser. No. 62/411,647, filed Oct. 23, 2016, which is incorporated herein by reference in its entirety.

BACKGROUND

In various well applications, a wellbore is drilled into a hydrocarbon bearing reservoir and then a pumping system may be deployed downhole. The pumping system is operated to pump oil and/or other fluids to the surface for collection. The pumping system may comprise an electric submersible pumping system having a submersible pump powered by a submersible electric motor. Thrust from the submersible pump is resisted by a thrust bearing working in cooperation with a thrust runner. In some applications, excess gas builds up between the thrust bearing and the thrust runner. The excess gas may cause wear and sometimes failure of the thrust bearing.

SUMMARY

In general, the present disclosure provides a system and method for removing gas from a gas-sensitive region, e.g. from a thrust bearing section, in an electric submersible pumping system. A gas purging system is integrated into the electric submersible pumping system. During operation of the electric submersible pumping system, the gas purging system also is operated to move gas away from the gas-sensitive region and to a collection region or other appropriate region. In some embodiments, the gas which accumulates in a collection region may be discharged to a region external of the electric submersible pumping system.

BRIEF DESCRIPTION OF THE DRAWINGS

Certain embodiments will hereafter be described with reference to the accompanying drawings, wherein like reference numerals denote like elements. It should be understood, however, that the accompanying figures illustrate various implementations described herein and are not meant to limit the scope of various technologies described herein, and.

DETAILED DESCRIPTION

Figure 1:
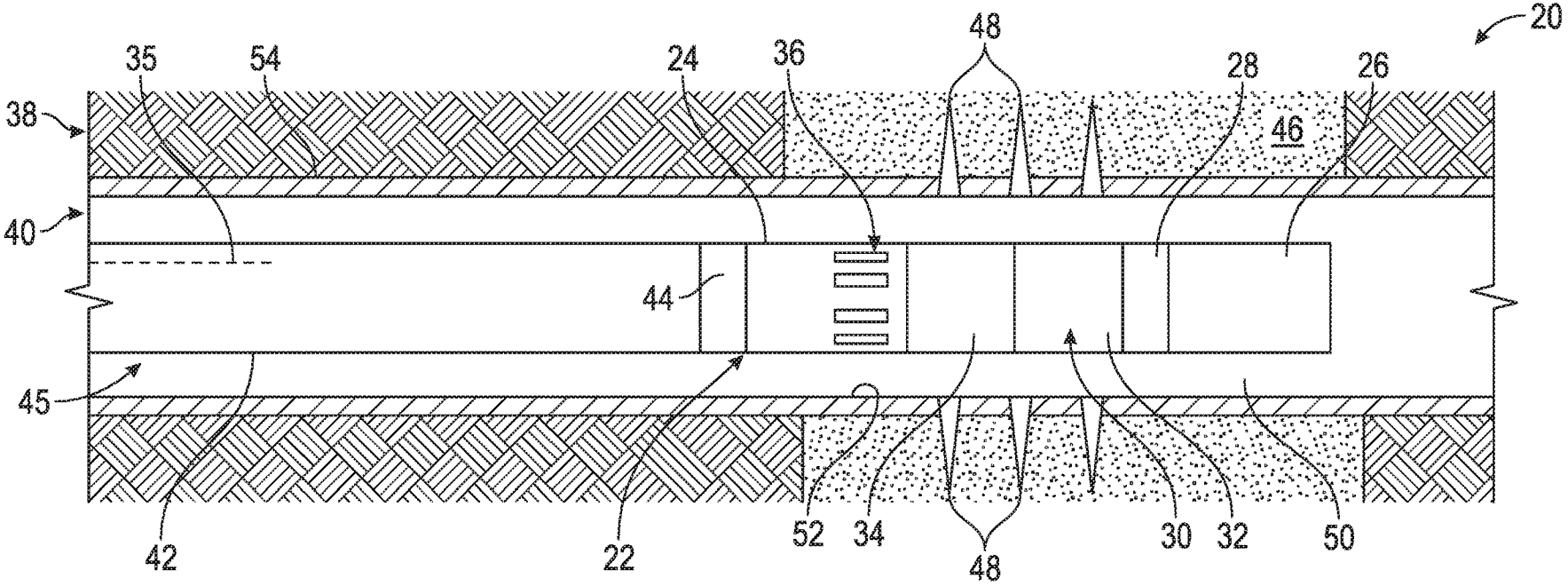
FIG. 1 is a schematic illustration of an example of a well system having an electric submersible pumping system deployed in a lateral section, e.g. a horizontal section, of a borehole, according to an embodiment of the disclosure.

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a system and method for removing gas from a region within an electric submersible pumping system. For example, gas may be removed from a thrust bearing section of the pumping system. A gas purging system may be integrated into the electric submersible pumping system to effectively remove gas from the region, e.g. thrust bearing section, when the electric submersible pumping system is in a horizontal orientation or various other orientations. For example, the gas purging system works well for removing gas from the thrust bearing section of a horizontal electric submersible pumping system disposed in a lateral wellbore.

During operation of the electric submersible pumping system, a submersible pump is rotated by a submersible motor via a shaft. According to an embodiment, the gas purging system also is operated via rotation of the shaft to move gas away from the thrust bearing section and to a collection region or other suitable region. The gas purging system may comprise one or more features which operate to remove gas from the thrust bearing section and to transfer the gas to the collection region, e.g. to a sump chamber. In some embodiments, gas which accumulates in the collection region may be discharged to a region external of the electric submersible pumping system.

According to an embodiment, an electric submersible pumping system comprises a thrust bearing section equipped with hydrodynamic thrust bearings which carry thrust generated by the submersible pump. In non-horizontal applications, the thrust bearings also may carry the weight of pumping system components. A thrust runner is attached to a shaft and rides on a film of motor oil separating the thrust runner from the thrust bearing. Gas liberated from the motor oil tends to become trapped at a radially inward region between the thrust bearing and the shaft as rotation of the shaft and thrust runner tends to centrifuge the gas against the shaft. The layer of trapped gas may grow until it detrimentally interrupts the fluid film between the thrust runner and the thrust bearing and may ultimately cause thrust bearing damage or failure. It should be noted the gas may not be entirely liberated from the motor oil and may exist in a mixed fluid state, e.g. a gassy oil. However, the gas in such gassy oil may be sufficient to cause damage to or failure of the affected thrust bearing.

The thrust bearing section may be located at various positions along the electric submersible pumping system. For example, the thrust bearing section (or thrust bearing sections) may be positioned in the submersible pump, submersible motor, or motor protector. In various embodiments, the thrust bearing section is positioned in a motor protector but the motor protector may have a variety of instructions. Some motor protectors utilize a shaft seal module with a thrust bearing section. The shaft seal module may have limited communication with the submersible motor and this can limit the natural capability of the system to remove gas.

However, the gas purging system described herein is highly effective at removing gas from thrust bearing sections located in shaft seal modules or located in other types of protectors or submersible pumping system components.

Depending on the application, the gas purging system may comprise a variety of pumping features which effectively remove gas, e.g. gassy motor oil, from the thrust bearing section. By way of example, the gas purging system may comprise pumping features which facilitate removal of gas following centrifugal separation of gas from motor oil via rotation of the shaft and thrust runner. Gas removal may involve venting or pumping of the gas from various gas collection regions adjacent the thrust runner.

The pumping features may comprise a helical groove formed, e.g. milled, along the shaft or other pumping features disposed along the shaft. The gas may be pumped to a collection region, such as a bubble sump chamber located at a position separated from the thrust bearing section. Some embodiments may further utilize gravity separation of gas from the oil in the sump chamber. Baffles may be used to enhance the gravity separation. Vanes, blades, or other separation features also may be used to help separate gas from the motor oil for subsequent removal. In some embodiments, flow passages may be arranged to effectively enable pumping of gas away from the thrust bearing section and to simultaneously move motor oil toward the thrust bearing section. Gas collected in the sump chamber may be routed to a relief valve via passageways oriented to vent gas from the electric submersible pumping system.

Referring generally to FIG. 1, an embodiment of a well system 20 is illustrated as comprising an electric submersible pumping system 22. In this example, the electric submersible pumping system 22 comprises a submersible pump 24, e.g. a submersible centrifugal pump, powered by a submersible motor 26 via a shaft. The illustrated electric submersible pumping system 22 further comprises a thrust section 28 which counters the thrust exerted by submersible pump 24 during operation of electric submersible pumping system 22.

The thrust section 28 may be contained within a motor protector 30 or within another component of electric submersible pumping system 22. By way of example, the motor protector 30 may comprise a compensator 32 and a shaft seal module 34 although other types of motor protectors 30 may be utilized. In some embodiments, the motor protector 30 or components of motor protector 30, e.g. compensator 32, may be located on an opposite end of the submersible motor 26.

The submersible motor 26 is powered via electric power supplied through a power cable 35. During operation of electric submersible pumping system 22, the submersible motor 26 rotates a shaft which powers the submersible pump 24. Operation of submersible pump 24 causes a well fluid, e.g. oil, to be drawn into pumping system 22 through a pump intake 36. It should be noted the motor oil within submersible motor 26, motor protector 30, and thrust section 28 is separated from the well fluid via features of motor protector 30.

According to an embodiment, the electric submersible pumping system 22 is deployed downhole into a well 38 having a lateral wellbore section 40. In the example illustrated, the lateral wellbore section 40 is generally horizontal and the electric submersible pumping system 22 is utilized as a horizontal system within wellbore section 40. However, the submersible pumping system 22 also may be used in generally vertical wellbore sections or other types of boreholes. The electric submersible pumping system 22 is deployed downhole via a conveyance 42, e.g. production tubing or coiled tubing, which is coupled with the pumping system 22 via a connector 44. It should be noted the submersible pumping system 22 may be part of various types of well strings 45 deployed downhole.

In production operations, well fluid flows from a surrounding formation 46, through perforations 48, and into wellbore section 40. The well fluid flows along an annulus 50 between the electric submersible pumping system 22 and a surrounding wellbore wall 52 until entering the pumping system 22 through pump intake 36. The wellbore wall 52 may be an open hole wellbore wall or a wall formed by a casing 54.

Figure 2:
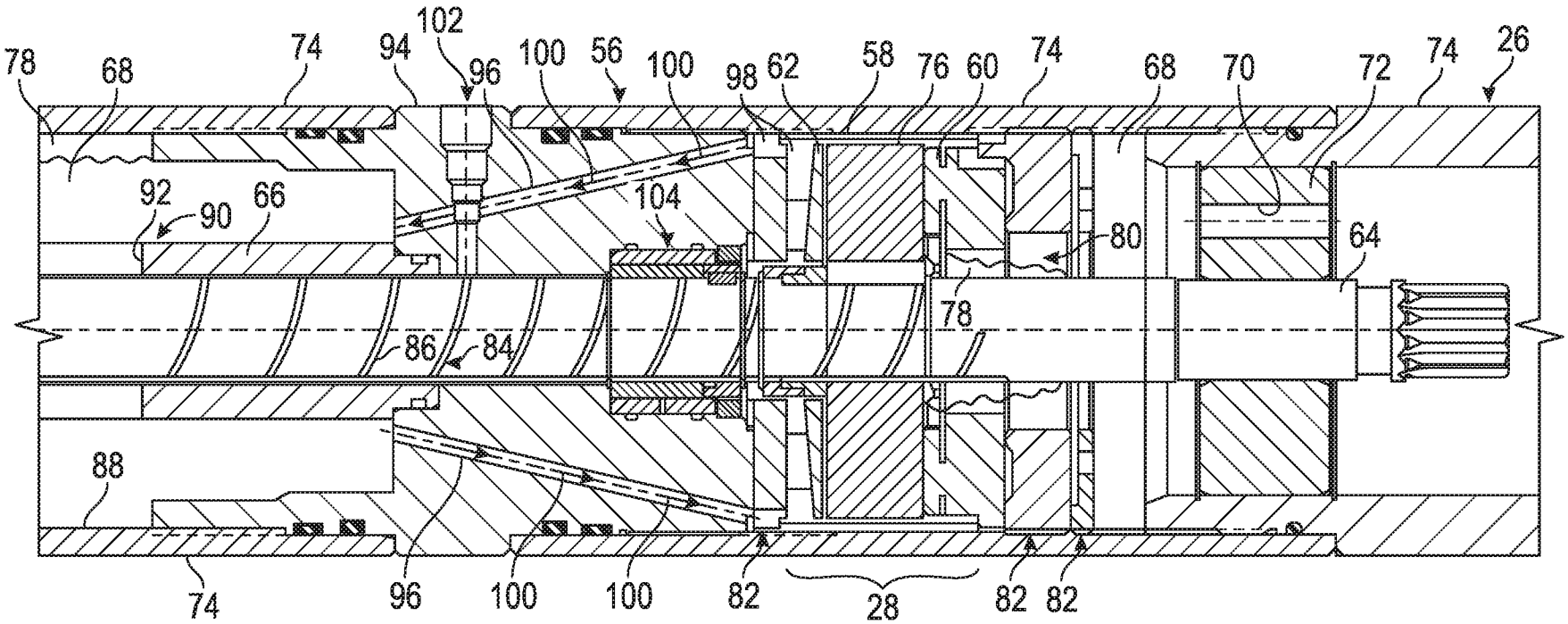
FIG. 2 is a cross-sectional view of a portion of the electric submersible pumping system having a thrust bearing section working in cooperation with a gas purging system, according to an embodiment of the disclosure.

Referring generally to FIG. 2, a cross-sectional view of a portion of the electric submersible pumping system 22 is provided to illustrate an example of the thrust bearing section 28 combined with a gas purging system 56. The gas purging system 56 comprises features which operate to remove gas from the thrust bearing section 28 which could otherwise cause wear or even failure of the thrust bearing section 28. However, the gas purging system 56 may be used to remove gas from other portions of electric submersible pumping system 22 or from other well string components.

In the illustrated example, the thrust bearing section 28 comprises a thrust runner 58 which works in cooperation with at least one thrust bearing, such as a down thrust bearing 60 and an up thrust bearing 62. By way of example, the thrust runner 58 may be mounted to a shaft 64 rotationally mounted within a shaft tube 66. The shaft 64 may be part of a multi-segment shaft by which submersible motor 26 powers submersible pump 24.

During operation of submersible pump 24, the thrust of the submersible pump 24 is transferred through shaft 64 and countered via thrust bearing section 28. The thrust runner 58 rotates with shaft 64 and is forced axially against thrust bearing 60 to counter down thrust or against thrust bearing 62 to counter up thrust. A motor oil 68 may move between submersible motor 26 and thrust bearing section 28 via, for example, a flow passage 70 extending through a bulkhead 72. The bulkhead 72 as well as thrust bearing section 28 may be disposed within sections of an outer housing 74. A small gap 76 may be disposed between thrust runner 58 and the surrounding outer housing 74 to enable rotation of thrust runner 58 within outer housing 74.

During rotation of thrust runner 58, centrifugal separation of a gas 78 from motor oil 68 may occur which causes the gas 78 to accumulate at a radially inward region 80. As illustrated, the radially inward region 80 may occur along shaft 64 proximate thrust runner 58 and corresponding thrust bearing 60. As explained in greater detail below, the gas 78 may be vented via gas purging system 56 so as to ensure a suitable film of the motor oil 68 remains between thrust runner 58 and the corresponding thrust bearing(s) 60/62.

It should be noted the gas 78 may be contained within a gassy oil portion of the motor oil 68. For example, the centrifugal action of thrust runner 58 may cause formation of a lighter weight, mixed ratio oil containing gas 78. The lighter weight oil containing gas 78 moves to radially inward region 80 while the heavier motor oil 68 (containing no gas or reduced gas) moves radially outward relative to region 80. The gas purging system 56 is able to remove gas 78 by removing the lighter weight mixed ratio oil from radially inward region 80. The centrifugal action results when thrust runner 58 rotates relative to stationary thrust bearings 60/62 which may be rotationally fixed with respect to outer housing 74 via a variety of mounting structures 82.

According to the embodiment illustrated in FIG. 2, gas purging system 56 utilizes shaft 64 in combination with a gas pumping feature 84 to move gas 78 away from the radially inward region 80 proximate thrust runner 58. By way of example, the gas pumping feature 84 may comprise a groove 86 disposed along an exterior (or interior) of shaft 64. The groove 86 operates during rotation of shaft 64 to move gas 78 from region 80 to, for example, a sump chamber 88.

By way of further example, the groove 86 may be a helical groove milled or otherwise formed along an exterior of shaft 64 so as to create the desired gas pumping action during rotation of shaft 64. Effectively, the helical groove 86 works as a screw pump which moves the gas 78 (e.g. gas 78 contained in gassy oil) along the shaft 64 to sump chamber 88. In some embodiments, the groove 86 may extend at least partially through thrust runner 58 and along an exterior surface of shaft 64 or along the interior of shaft 64. Various gaps may be formed along rings, radial bearings, and other features disposed along shaft 64 to ensure the flow of gas 78 from the desired region, e.g. radially inward region 80, to sump chamber 88.

The sump chamber 88 of gas purging system 56 may be positioned to receive the gas 78 from pumping feature 84 via a diffuser 90, e.g. a radial opening or openings 92, formed through shaft tube 66. The sump chamber 88 may be formed between shaft tube 66 and a surrounding section of outer housing 74. In some embodiments, the diffuser 90 is constructed with radial openings 92 arranged at an angle which positively directs the gas 78 away from the shaft 64. The diffuser 90 also may have vanes or other features attached to the shaft tube 66 which curve from a generally circumferential orientation to a generally radial orientation. Additionally, the diffuser 90 may have helical passages arranged with respect to shaft 64 to change the direction of flow from generally axial to generally radial. In some embodiments, the groove 86 also may be reversed in orientation or combined with other features downstream of diffuser 90 to limit the amount of gas, e.g. bubbles, flowing past the diffuser 90.

In the embodiment illustrated, the gas purging system 56 also comprises a body section 94 disposed between the sump chamber 88 and the thrust runner 58. The body section 94 may comprise a plurality of passages 96 in the form of recirculation passages oriented at a desired angle relative to shaft 64. For example, the recirculation passages 96 may be oriented through body section 94 such that ends of the passages 96 proximate sump chamber 88 are at a radially inward position while ends of the passages 96 proximate thrust bearing section 28 are at a radially outward position as illustrated.

When the electric submersible pumping system 22 is oriented horizontally, heavier motor oil 68 settles downwardly and lighter gas 78 moves upwardly in the sump chamber 88 as illustrated in FIG. 2. During rotation of shaft 64 and movement of gassy oil along groove 86, the head established by motor oil 68 in sump chamber 88 facilitates an additional pumping action as the heavier motor oil 68 moves from sump chamber 88 back to thrust bearing section 28 along the lower recirculation passages 96. This movement effectively forces movement of gas 78 or lighter weight gassy oil from a radially outward/upper region 98 located proximate upper thrust bearing 62. The gas 78 (e.g. gas 78 contained within a gassy oil) is moved from region 98, along the upper recirculation passages 96, and into sump chamber 88 as indicated by circulation arrows 100. This pumping action along recirculation passages 96 further facilitates removal of gas 78 from thrust bearing section 28.

Figure 3:
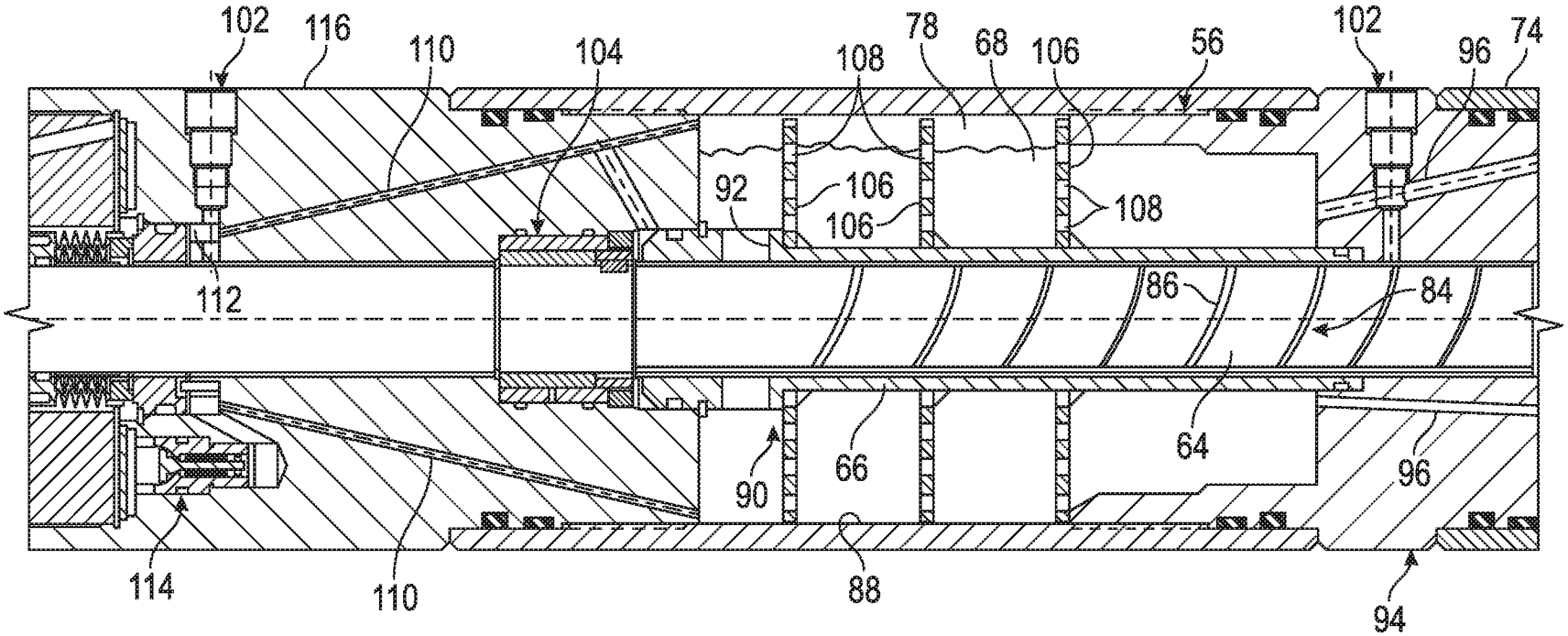
FIG. 3 is a cross-sectional view of another portion of the gas purging system, according to an embodiment of the disclosure.

Depending on the parameters of a given application, the gas purging system 56 and thrust bearing section 28 may be located adjacent to or within various components of electric submersible pumping system 22 and may comprise various other and/or additional features such as access ports 102 and radial bearing assemblies 104. Referring generally to FIG. 3, examples of additional features and components which may be included in gas purging system 56 are illustrated. In the embodiment of FIG. 3, gas purging system 56 comprises at least one baffle 106 oriented generally radially between shaft tube 66 and the surrounding section of housing 74.

By way of example, the at least one baffle 106 may comprise a plurality of baffles 106 having passages 108 therethrough to enable movement of fluid along sump chamber 88 while limiting fluid agitation. By baffling the fluid in sump chamber 88, gas 78 is better able to separate from motor oil 68 for collection along an upper region of the sump chamber 88 as illustrated. It should be noted the embodiment of FIG. 3 illustrates diffuser 90 as positioned at a distal end of sump chamber 88 relative to thrust bearing section 28.

The gas purging system 56 also may comprise other features such as a plurality of gas discharge passages 110 routed from the sump chamber 88 to a collection space 112 and then to a relief valve 114. The gas discharge passages 110 and relief valve 114 cooperate to discharge gas from sump chamber 88 to, for example, annulus 50 surrounding the electric submersible pumping system 22. The relief valve 114 may be selected so as to crack or shift to an open flow position when the pressure of gas 78 acting on relief valve 114 reaches a predetermined cracking pressure. In some embodiments, a plurality of relief valves 114 may be positioned to ensure at least one of the relief valves 114 is positioned toward a top side regardless of the orientation of the electric submersible pumping system 22.

According to an embodiment, the gas discharge passages 110 may be routed through a second body section 116 located on an opposite side of sump chamber 88 relative to body section 94. The body section 94 and second body section 116 may be connected by a section of the outer housing 74. Additionally, the size of gas discharge passages 110 may be selected to limit the flow of motor oil 68 therethrough while readily flowing gas 78 to facilitate removal of gas 78 from sump chamber 88.

Figure 4:
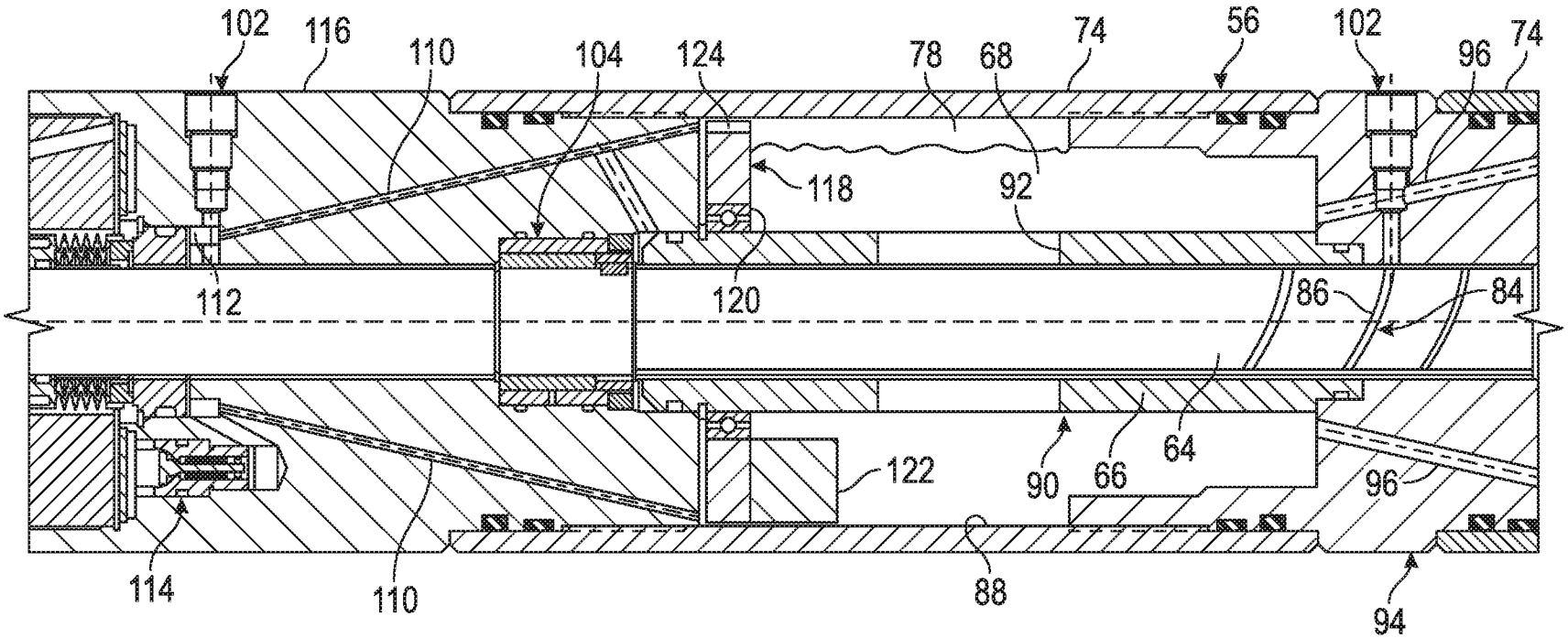
FIG. 4 is a cross-sectional view of another example of the gas purging system, according to an embodiment of the disclosure.

Referring generally to FIG. 4, the flow of motor oil 68 through gas discharge passages 110 also may be limited by utilizing a weighted disc 118 rotatably mounted about shaft tube 66 via bearings 120. When the electric submersible pumping system 22 is a horizontal system, a weight 122 of weighted disc 118 moves via gravity to a bottom position as illustrated in FIG. 4. The weighted disc 118 is solid proximate weight 122 and effectively blocks flow of motor oil 68 into the lower gas discharge passage(s) 110. However, the opposite side (upper illustrated side) of weighted disc 118 comprises an opening or openings 124 which align with the upper gas discharge passage(s) 110. The alignment of openings 124 with passages 110 enables movement of gas 78 through the upper gas discharge passage(s) 110 to the collection space 112 and ultimately to gas relief valve 114 for discharge from the electric submersible pumping system 22.

Figure 5:
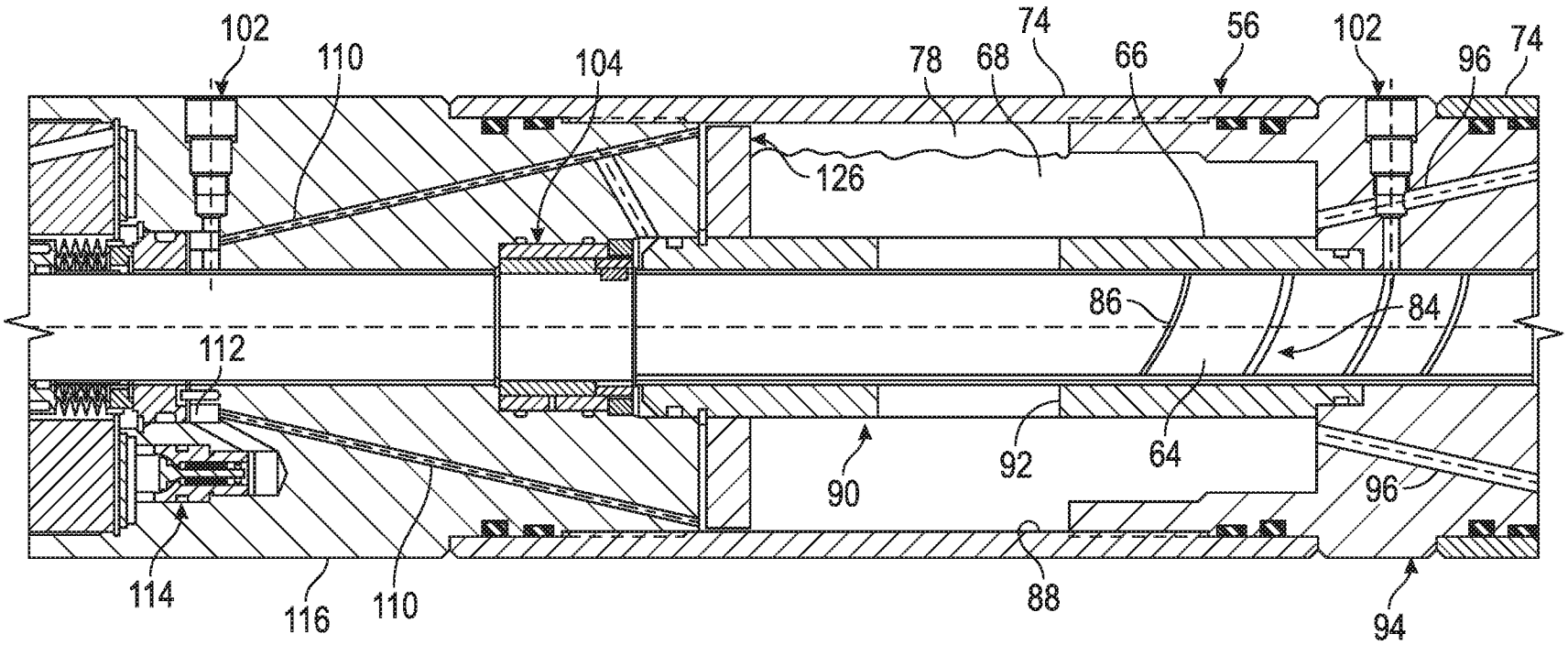
FIG. 5 is a cross-sectional view of another example of the gas purging system, according to an embodiment of the disclosure.

In another example, a filter 126 may be positioned within sump chamber 88 proximate gas discharge passages 110 as illustrated in FIG. 5. The filter 126 is selected with appropriate filter opening sizes, e.g. pore sizes, to readily enable flow of gas 78 into gas discharge passages 110 while restricting the flow of motor oil 68. Depending on the application, the filter 126 also may be in the form of a fabric with suitable pore sizes or a semi-permeable membrane which allows passage of gas 78 while limiting or blocking passage of motor oil 68. By way of further example, a gas discharge passage 110 could be coupled with a flexible tube having a float to ensure the intake of the flexible tube is within the upper gas collection region.

Figure 6:
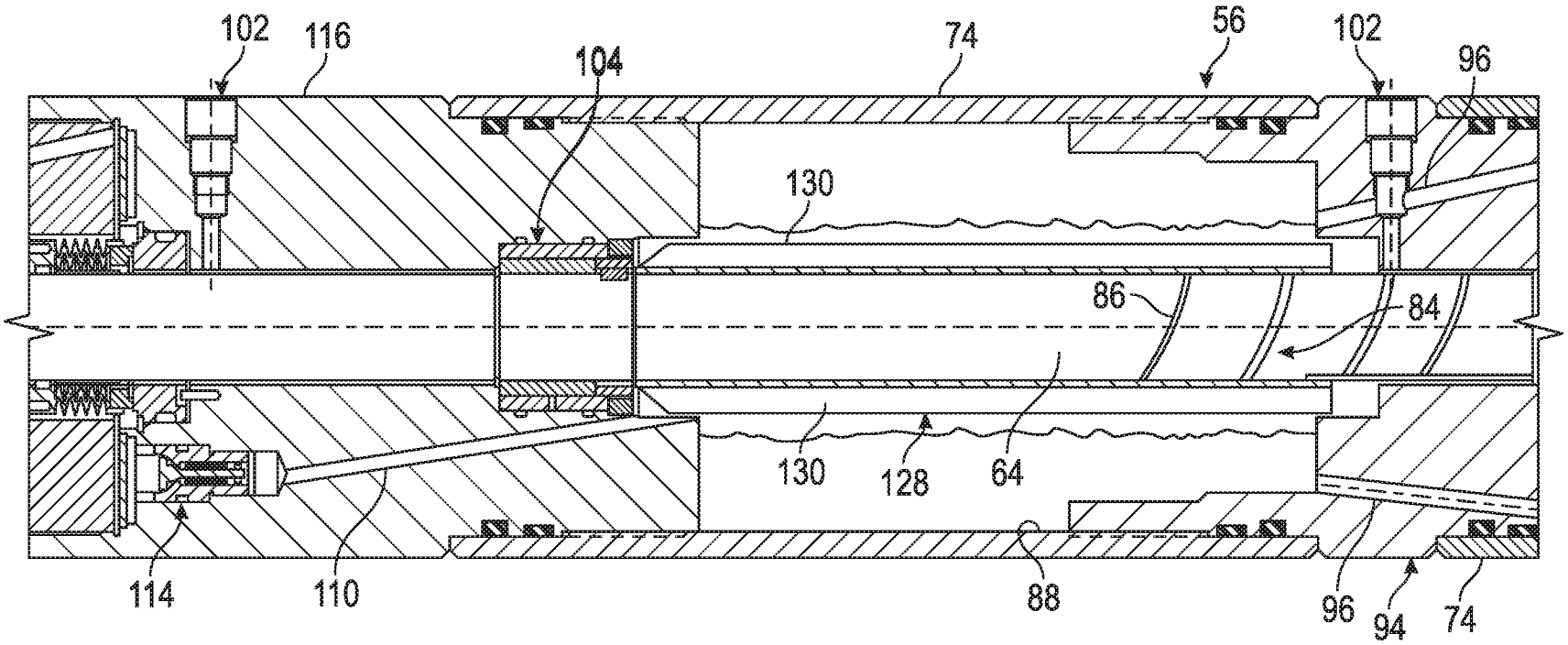
FIG. 6 is a cross-sectional view of another example of the gas purging system, according to an embodiment of the disclosure.

Referring generally to FIG. 6, another embodiment is illustrated as comprising a centrifugal agitator 128 mounted along shaft 64 generally within the region of sump chamber 88. By way of example, the centrifugal agitator 128 may comprise a plurality of paddles 130, an impeller, or other centrifugal devices to help separate gas 78 from motor oil 68. With some types of motor oil and in some applications, the centrifuging of motor oil 68 helps release gas 78 from the motor oil for removal via, for example, gas discharge passages 110. As shaft 64 is rotated via submersible motor 26, the paddles 130 or other agitators effectively centrifuge the motor oil 68 to aid gas release.

Depending on the parameters of a given operation, the gas purging system 56 may be constructed with various arrangements of the features described herein. For example, the pumping feature 84 along shaft 64 may be omitted in some applications and recirculation passages 96 may be used alone (or vice versa). Some embodiments may utilize gravity separation with the aid of baffles 106 while other embodiments may utilize centrifugal agitator 128 to enhance separation of gas 78 from motor oil 68. In some applications, however, a combination of gravity separation and agitation may be used to facilitate separation of gas 78.

The gas purging system 56 also may be employed to remove gas from other gas-sensitive components or regions in addition to or other than thrust chamber section 28, e.g. other regions such as a radial bearing section, a mechanical shaft seal region, and an electrical conductor region. Various types of pumping features 84 also may be employed along shaft 64 to remove gas from radially inward region 80 so as to limit migration of gas 78 into the oil film between thrust runner 58 and the corresponding thrust bearing, e.g. thrust bearing 60. Variations of the gas purging system 56 also may be used in vertical electric submersible pumping systems to, for example, purge gas from beneath the thrust runner 58. In some embodiments, the gas purging system 56 is disposed within motor protector 30 in a manner which directs the gas 78 into a bag, metal bellows chambers, or other gas handling features of the motor protector 30.

Depending on the parameters of a given well operation, the type, size, orientation, and features of electric submersible pumping system 22 may be changed. The thrust bearing section 28 may be positioned in the motor protector 30 or at other locations along the electric submersible pumping system 22. Similarly, the gas purging system 56 may be positioned in the motor protector 30, within other components of pumping system 22, or within a standalone component coupled into the pumping system 22.

The gas separation and fluid movement features and systems may be used in various combinations according to the parameters of a given application. In some applications, for example, the separated gas may be released to a surrounding region rather than flowed into a sump chamber. The groove or other pumping feature formed along the shaft may be used alone or in combination with other passages/features to facilitate movement of gas in an axial direction along the shaft. Similarly, various combinations of recirculation passages, gas discharge passages, and other passages may be arranged in desired orientations to achieve gas separation and/or removal.

Although a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

an electric submersible pumping system having a submersible motor, a motor protector, a submersible pump powered by the submersible motor, a gas-sensitive section positioned in the motor protector and comprising a thrust bearing and a thrust runner which rotate relative to each other when the shaft is rotated, and a gas purging system to remove gas from the gas-sensitive section, the gas purging system comprising:

a shaft;

a pumping feature driven by rotation of the shaft to draw gas away from a radially inward region of the gas-sensitive section; and a sump chamber positioned to receive the gas from the pumping feature via a diffuser disposed radially through a shaft tube positioned around the shaft.

2. The system as recited in claim 1, wherein the pumping feature comprises a helical groove formed along the shaft.

3. The system as recited in claim 1, wherein the electric submersible pumping system is a generally horizontal electric submersible pumping system.

4. The system as recited in claim 1, wherein the gas purging system comprises a body section disposed between the sump chamber in the thrust runner, the body section having a plurality of passages therethrough, the passages being oriented to move gas away from the thrust runner and to move motor oil to the thrust runner as the shaft is rotated.

5. The system as recited in claim 4, wherein the gas purging system comprises a plurality of gas discharge passages routed from the sump chamber to a relief valve to discharge gas from the sump chamber.

6. The system as recited in claim 5, wherein the gas purging system comprises a plurality of baffles arranged in the sump chamber to facilitate separation of gas and motor oil in the sump chamber.

7. The system as recited in claim 5, wherein the gas purging system comprises a filter positioned to filter motor oil from gas as a mixed gas and motor oil fluid flows to the plurality of gas discharge passages.

8. The system as recited in claim 5, wherein the gas purging system comprises a weighted disc which automatically orients to block flow of fluid into lower gas discharge passages of the plurality of gas discharge passages and to allow flow of fluid into upper gas discharge passages of the plurality of gas discharge passages when the electric submersible pumping system is generally horizontal.

9. A system, comprising:

an electric submersible pumping system having a submersible motor, a motor protector, a submersible pump powered by the submersible motor via a shaft, a gas-sensitive section positioned in the motor protector and comprising a thrust bearing section having a thrust bearing and a thrust runner, and a gas purging system to remove gas from the gas-sensitive section, the gas purging system comprising:

a sump chamber; and a body section disposed between the sump chamber and the thrust runner, the body section having a plurality of passages therethrough, the passages being oriented to move gas away from the thrust runner and to move motor oil to the thrust runner as the shaft is rotated.

10. The system as recited in room 10, wherein the gas purging system further comprises a pumping feature driven by rotation of the shaft to draw gas away from a radially inward region of the thrust bearing section, the sump chamber being positioned to receive the gas from the pumping feature via a diffuser disposed radially through a shaft tube positioned around the shaft.

11. The system as recited in claim 10, wherein the pumping feature comprises a helical groove formed along the shaft.

12. The system as recited in claim 10, wherein the gas purging system comprises a plurality of gas discharge passages routed from the sump chamber to a relief valve to discharge gas from the sump chamber; and a plurality of baffles arranged in the sump chamber to facilitate separation of gas and motor oil in the sump chamber.

13. The system as recited in claim 9, wherein the gas purging system further comprises a centrifugal agitator mounted on the shaft along the sump chamber to facilitate separation of gas from motor oil.

14. A method of removing gas during a well pumping operation, comprising:

providing an electric submersible pumping system with a submersible pump driven by a submersible motor containing a motor oil;

resisting thrust of the submersible pump with a thrust bearing section having a thrust bearing and a corresponding thrust runner mounted on a rotatable shaft of the electric submersible pumping system;

using a gas purging system to remove gas which collects along a radially inward region of the electric submersible pumping system when the gas is liberated from the motor oil; and pumping the gas, which is liberated from the motor oil, to a sump chamber.

15. The method as recited in claim 14, wherein pumping gas comprises using a helical groove along the shaft to move the gas along the shaft from the thrust bearing section to the sump chamber during rotation of the shaft.

16. The method as recited in claim 14, further comprising using baffles in the sump chamber to improve separation of gas from the motor oil.

17. The method as recited in claim 14, further comprising orienting a plurality of passages through a body section between the sump chamber and the corresponding thrust runner; and orienting the electric submersible pumping system substantially horizontally to enable a pumping action through the plurality of passages to remove gas from the thrust bearing section.

18. The method as recited in claim 14, further comprising locating a plurality of gas discharge passages between the sump chamber and a relief valve to facilitate discharge of gas from the sump chamber.

* * * * *